US010371368B2

(12) United States Patent
Maxik et al.

(10) Patent No.: US 10,371,368 B2
(45) Date of Patent: Aug. 6, 2019

(54) CANOPY LIGHT SYSTEM

(71) Applicant: Lighting Science Group Corporation, Cocoa Beach, FL (US)

(72) Inventors: Fredric S. Maxik, Cocoa Beach, FL (US); David E. Bartine, Cocoa, FL (US); James Lynn Schellack, Skiatook, OK (US); Addy S. Widjaja, Palm Bay, FL (US)

( * ) Notice: Subject to any disclaimer, the term of this patent is extended or adjusted under 35 U.S.C. 154(b) by 0 days.

(21) Appl. No.: 15/244,091

(22) Filed: Aug. 23, 2016

(65) Prior Publication Data

US 2016/0356482 A1 Dec. 8, 2016

Related U.S. Application Data

(62) Division of application No. 13/887,799, filed on May 6, 2013, now Pat. No. 9,441,815.
(Continued)

(51) Int. Cl.

| | |
|---|---|
| ***H05B 37/02*** | (2006.01) |
| ***F21V 15/01*** | (2006.01) |
| ***F21V 29/77*** | (2015.01) |
| ***F21V 23/00*** | (2015.01) |
| ***F21V 29/507*** | (2015.01) |

(Continued)

(52) U.S. Cl.
CPC ..... *F21V 29/77* (2015.01); *F21S 8/04* (2013.01); *F21V 15/01* (2013.01); *F21V 19/003* (2013.01); *F21V 23/001* (2013.01); *F21V 23/008* (2013.01); *F21V 23/009* (2013.01); *F21V 23/02* (2013.01); *F21V 23/06* (2013.01); *F21V 29/507* (2015.01); *F21Y 2115/10* (2016.08)

(58) Field of Classification Search
CPC ..... F21V 15/01; F21V 15/011; F21V 23/00; F21V 23/008; F21V 23/009; F21V 29/507; H05B 33/08; H05B 37/02
USPC .... 315/185 R, 112, 113, 117, 118, 291, 307; 362/218, 294, 345, 370, 373, 580, 800, 362/249.01, 249.02
See application file for complete search history.

(56) References Cited

U.S. PATENT DOCUMENTS 5,997,158 A 12/1999 Fischer et al.
6,149,280 A 11/2000 Quiogue et al.
(Continued)

OTHER PUBLICATIONS

California Department of Transportation, "Wire Sizes and Maximum Length Determination", Jul. 5, 2007, <http://www.zelatalk.com/energy/tengy10s.pdf> (11 Pages).
(Continued)

*Primary Examiner* — Jimmy Vu
(74) *Attorney, Agent, or Firm* — Mark Malek; Daniel C. Pierron; Widerman Malek, PL

(57) ABSTRACT

A retrofit lighting system is provided comprising a power supply assembly configured to convert an AC input voltage into a DC output voltage and to adapt the DC output voltage to a substantially constant current level to be defined as a regulated current, at least one distribution wire in electrical communication with the power supply assembly and configured to conduct the regulated current, and at least one respective luminaire assembly spaced apart from and in electrical communication with the power supply assembly, and configured to receive the regulated current from the at least one distribution wire. The DC output voltage may be about 12 volts or less.

11 Claims, 7 Drawing Sheets

Related U.S. Application Data

(60) Provisional application No. 61/643,302, filed on May 6, 2012.

(51) Int. Cl.

| | |
|---|---|
| ***F21S 8/04*** | (2006.01) |
| ***F21V 19/00*** | (2006.01) |
| ***F21V 23/02*** | (2006.01) |
| ***F21V 23/06*** | (2006.01) |
| *F21Y 115/10* | (2016.01) |

(56) References Cited

U.S. PATENT DOCUMENTS

| | | | | |
|---|---|---|---|---|
| 8,247,821 | B2 | 8/2012 | Liao | |
| 8,251,552 | B2 | 8/2012 | Rooms et al. | |
| 8,256,919 | B2 * | 9/2012 | Holder | F21V 29/70 257/79 |
| 8,672,517 | B2 | 3/2014 | Chia-Tin et al. | |
| 8,674,616 | B2 | 3/2014 | Homan et al. | |
| 9,441,815 | B2 | 9/2016 | Maxik et al. | |
| 2011/0175533 | A1 * | 7/2011 | Holman | E04B 9/32 315/130 |
| 2012/0051048 | A1 | 3/2012 | Smit et al. | |

OTHER PUBLICATIONS

USPTO, Restriction Requirement for U.S. Appl. No. 13/887,799, now U.S. Pat. No. 9,441,815, dated Oct. 27, 2015. (6 Pages).

Applicant, Response to Restriction Requirement for U.S. Appl. No. 13/887,799, now U.S. Pat. No. 9,441,815, dated Dec. 22, 2015. (3 Pages).

USPTO, Non-Final Office Action for U.S. Appl. No. 13/887,799, now U.S. Pat. No. 9,441,815, dated Jan. 15, 2016. (6 Pages).

Applicant, Response to Non-Final Office Action for U.S. Appl. No. 13/887,799, now U.S. Pat. No. 9,441,815, dated Apr. 12, 2016. (8 Pages).

USPTO, Notice of Allowance for U.S. Appl. No. 13/887,799, now U.S. Pat. No. 9,441,815, dated May 10, 2016. (8 Pages).

* cited by examiner

CANOPY LIGHT SYSTEM

RELATED APPLICATIONS

This application is a divisional of and claims benefit under 35 U.S.C. 120 of U.S. patent application Ser. No. 13/887,799 titled Canopy Light System and Associated Methods filed May 6, 2013, which in turn claims the benefit under 35 U.S.C. § 119(e) of U.S. Provisional Patent Application Ser. No. 61/643,302 titled Canopy Light System and Associated Methods filed May 6, 2012, the entire contents of each of which are incorporated herein by reference.

FIELD OF THE INVENTION

The present invention relates to the field of illumination systems and, more specifically, to the field of illumination systems used in canopy lighting applications, and associated methods.

BACKGROUND OF THE INVENTION

Canopy lights are commonly used in outdoor service areas of fuel stations and convenience stores. Lighted canopies provide shelter, visibility, and security for consumers, as well as inviting storefronts that increase consumer traffic for businesses.

As applied to canopy lighting systems, digital lighting technologies such as light-emitting diodes (LEDs) offer significant advantages over legacy light sources such as incandescent, high-intensity discharge (HID), and fluorescent lamps. These advantages include, but are not limited to, better lighting quality, longer operating life, and lower energy consumption. Consequently, LED-based lamps increasingly are being used not only in original product designs, but also in products designed to replace legacy light sources in conventional lighting applications such as canopy systems. However, a number of design challenges and costs are associated with replacing traditional lamps with LED illumination devices. These design challenges include manufacturing cost control, installation ease, and thermal management.

Supplying power to LEDs is a key factor in quantifying the total cost of both retrofitting and operating a canopy lighting solution. While many approaches to driving LEDs are known in the art, the complex designs of current LED-based linear illumination devices often suffer from high material and component costs. LEDs are low-voltage light sources, requiring a constant DC voltage or current to operate optimally. More specifically, LEDs require power adapters to convert AC power drawn from a main supply to the proper DC voltage, and to regulate the current flowing through during operation to protect the LEDs from line-voltage fluctuations. To convert and regulate voltage and current, LED devices are commonly supplemented with an individual power adapter connecting to an AC electric power source. Such devices are usually compact enough to fit inside a junction box. However, the requirement to employ multiple converters and regulators with each LED-based lighting device results in higher total cost for system components.

Replacement of legacy lighting solutions may be complicated by the need to adapt LED-based devices to meet legacy form standards. For example, in a commercial lighting system retrofit, disposal of a replaced light's housing in a canopy structure often is impractical. Consequently, retrofit canopy light systems often are designed to adapt to legacy housing, both functionally and aesthetically. Also, legacy wiring used for delivery of electrical service is often reused in current retrofit solutions. The distribution wire carrying voltages of 110V or 220V from the main power supply to the plurality of converting devices must be protected against electric shock for safe use. Because of such safety concerns, a design that uses high-voltage distribution wire may be less desirable than a design that employs low-voltage DC distribution wire. However, the difficulty of quickly and safely installing new wiring without having to replace or cut pathways in existing structures, such as sheetrock or metal siding, leads current designers to instead reuse legacy wiring.

Another challenge inherent to operating LEDs is heat. Thermal management describes a system's ability to draw heat away from the LED, either passively or actively. LEDs suffer damage and decreased performance when operating in high-heat environments. Moreover, when operating in a confined environment, the heat generated by an LED and its attending circuitry itself can cause damage to the LED. Heat sinks are well known in the art and have been effectively used to provide cooling capacity, thus maintaining an LED-based light bulb within a desirable operating temperature. However, heat sinks can sometimes negatively impact the light distribution properties of the light fixture, resulting in non-uniform distribution of light about the fixture. Heat sink designs also may add to the weight of an illumination device, thereby complicating installation, and also may limit available space for other components needed for delivering light.

The lighting industry is experiencing advancements in LED applications, some of which may be pertinent to improving the design of linear illumination devices.

U.S. Pat. No. 5,997,158 to Fischer et al. discloses a retrofit luminaire assembly for mounting to an existing canopy fixture. The assembly includes a planar panel with electrical control elements mounted to a top surface of the panel and a light-emitting lamp mounted to a bottom surface of the panel. However, reliance on oppositely directed pivot members to mechanically support the planar panel when installed limits the size of canopy fixture housings to which the retrofit may be applied. Also, the depth of the electrical control elements presumes recessed mounting within an existing canopy fixture, thereby precluding low-profile flush-mounting applications.

U.S. Pat. No. 8,251,552 to Rooms et al. discloses an LED-based canopy luminaire designed for installation in a pre-existing fixture housing such that retrofitting requires minimum user effort and time. The canopy luminaire comprises a light panel, an external mounting panel, a connector plate, a power control unit, and a driver plate. However, including an expensive on-board power control unit for conversion and conditioning of power sacrifices manufacturing cost for the sake of installation ease. Also, construction and assembly of the many separate components listed above adds to design complexity and cost for the disclosed canopy luminaire.

U.S. Patent Application Publication No. 2012/0051048 by Smit et al. discloses a kit for retrofitting a non-LED canopy or other light fixture for use with LED lamps. The retrofit kit comprises a plurality of LED lamp units configured to attach to a cover replacement unit. However, similar to the Rooms disclosure, each of the LED lamp units is in electrical communication with a respective one of many on-board power supply units. Addition of power supply units not only add manufacturing cost to the retrofit kit, but also limits installation ease by requiring space for a power supply unit to extend through a canopy and into a legacy fixture (as in the Fischer disclosure).

Accordingly, a need exists for a low-profile, LED-based canopy light system that is less expensive to manufacture and assemble, easier and safer to install as a retrofit, and efficient at heat dissipation.

This background information is provided to reveal information believed by the applicant to be of possible relevance to the present invention. No admission is necessarily intended, nor should be construed, that any of the preceding information constitutes prior art against the present invention.

SUMMARY OF THE INVENTION

With the foregoing in mind, embodiments of the present invention are related to a low-profile, LED-based canopy light system that may be used advantageously to retrofit a down light fixture of a traditional canopy light. The canopy light system of an embodiment of the present invention may advantageously be less expensive to manufacture and assemble than traditional retrofit canopy light solutions. The canopy light system of an embodiment of the present invention may advantageously be easier and safer to install than traditional retrofit canopy light solutions. The canopy light system of an embodiment of the present invention may advantageously be efficient at heat dissipation.

The canopy light system may comprise a power supply assembly, at least one distribution wire, and at least one luminaire assembly. Each luminaire assembly may be spaced apart from and in electrical communication with the power supply assembly. Each luminaire assembly may be configured to receive an electric current from a respective distribution wire configured to extend from the power supply assembly to the luminaire assembly.

The power supply assembly may be configured to convert an AC input voltage into a DC output voltage. The DC output voltage may be about 12 volts or less. The power supply assembly may be configured to adapt the DC output voltage to a regulated current that may be characterized by a substantially constant current level.

Each distribution wire may be in electrical communication with the power supply assembly and may be configured to conduct the regulated current. Each distribution wire may comprise a wire of a gauge not wider than 20 AWG and a length of at least 10 feet, as well as a protective cover constructed of a weather-resistant material.

Each luminaire assembly may comprise a light source and a low profile heat-dissipating frame. The light source may comprise at least one light-emitting diode (LED) that may be attached to the lower surface of a substantially planar printed circuit board. Each luminaire assembly may comprise an optic positioned to form an optical chamber that may enclose the light source.

The frame may have a bottom portion comprising a central indentation. The light source may be carried within the central indentation in the frame, and may be in thermal contact with the frame. The bottom portion of the frame may include a plurality of heat sink fins. The heat sink fins may be positioned between an edge of the central indentation and a perimeter of the frame, and may be distributed substantially equidistant from each other along the perimeter of the frame. The optic may be mounted to the bottom portion of the frame.

The frame may have a top portion configured for flush mounting with a surface, and that includes a plurality of heat sink bars. The heat sink bars may be distributed substantially equidistant from each other and positioned within at least one recess substantially opposite the central indentation. The top portion of the frame may comprise a mechanism for engaging the top portion of the frame with a canopy fixture adjacent to the substantially flat surface. The engagement mechanism may comprise an integral mounting bracket and/or a combination bolt and support anchor.

At least one low-voltage DC electrical connector may pass through at least one aperture in the top portion of the frame to form an electrical connection between the distribution wire and the light source. The frame may be constructed of a thermally conductive material, such as metals, metal alloys, ceramics, and thermally conductive polymers.

A method aspect according to one embodiment of the present invention is for installing a retrofit canopy light system. The retrofit installation method may comprise mounting the power supply assembly to a surface some distance apart from the canopy fixture to be retrofitted, removing a legacy luminaire from its canopy fixture, connecting the power supply assembly to a first end of one of the plurality of distribution wires, extending a second end of the distribution wire to the vacant canopy fixture, connecting one of the plurality of respective luminaires to the second end of the distribution wire, and mounting the luminaire assembly to cover the existing fixture in the canopy. After the preceding steps are accomplished for all legacy luminaires to be replaced the method step of connecting the power supply assembly to a high-voltage power source may end the retrofit process.

DETAILED DESCRIPTION OF THE PREFERRED EMBODIMENT

The present invention will now be described fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Those of ordinary skill in the art will realize that the following embodiments of the present invention are only illustrative and are not intended to be limiting in any way. Other embodiments of the present invention will readily suggest themselves to such skilled persons having the benefit of this disclosure.

Although the following detailed description contains many specifics for the purposes of illustration, anyone of ordinary skill in the art will appreciate that many variations and alterations to the following details are within the scope of the invention. Accordingly, the following embodiments of the invention are set forth without any loss of generality to, and without imposing limitations upon, the claimed invention.

In this detailed description of the present invention, a person skilled in the art should note that directional terms, such as "above," "below," "upper," "lower," "front," "rear," and other like terms are used for the convenience of the reader in reference to the drawings. Also, a person skilled in the art should notice this description may contain other terminology to convey position, orientation, and direction without departing from the principles of the present invention. Like numbers refer to like elements throughout.

Referring now to FIGS. 1A-5, a canopy light system 100 used to replace a traditional canopy lighting solution, according to an embodiment of the present invention, is now described in detail. Throughout this disclosure, the present invention may be referred to as a canopy light system 100, a canopy illumination device, a canopy light, a light system, a light, a device, a system, a product, or a method. Those skilled in the art will appreciate that this terminology is only illustrative and does not affect the scope of the invention.

Example systems and methods for a canopy light retrofit solution are described herein below. In the following description, for purposes of explanation, numerous specific details are set forth to provide a thorough understanding of example embodiments. It will be evident, however, to one of ordinary skill in the art that the present invention may be practiced without these specific details and/or with different combinations of the details than are given here. Thus, specific embodiments are given for the purpose of simplified explanation and not limitation.

Figure 1A:
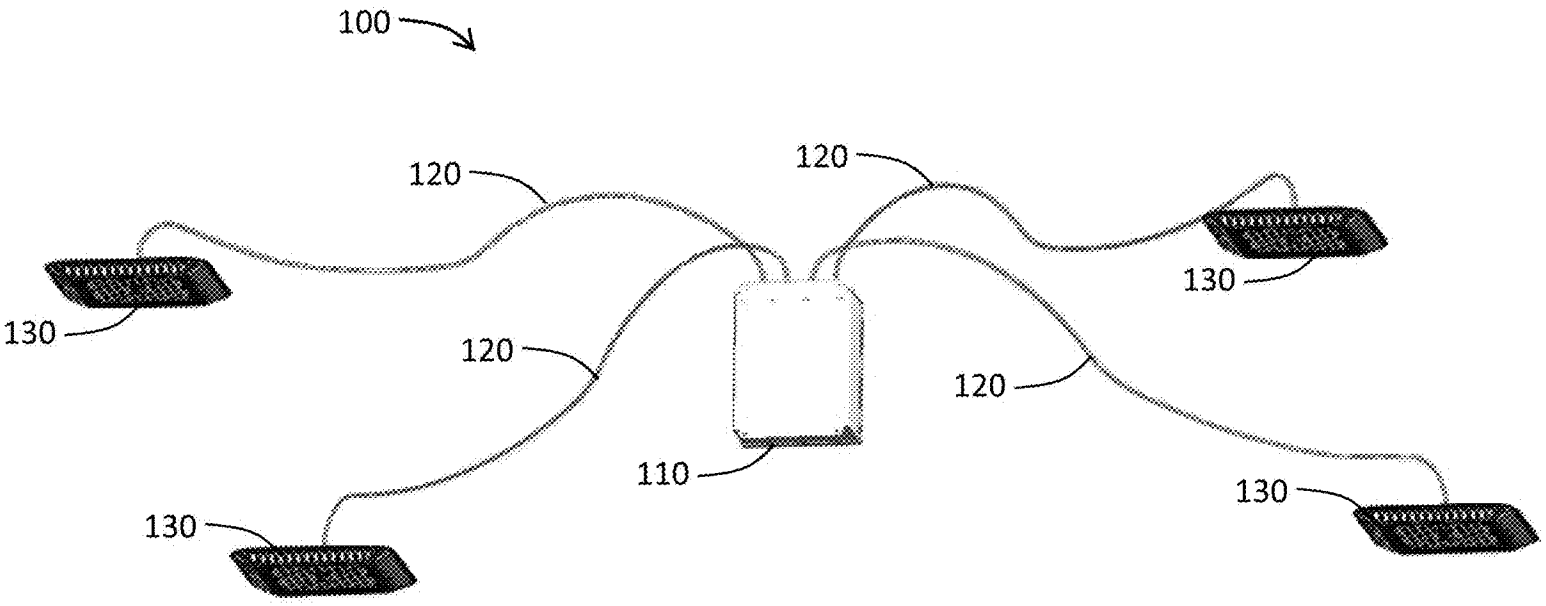
FIG. 1A is a bottom perspective view of a canopy light system according to an embodiment of the present invention.
Figure 1B:
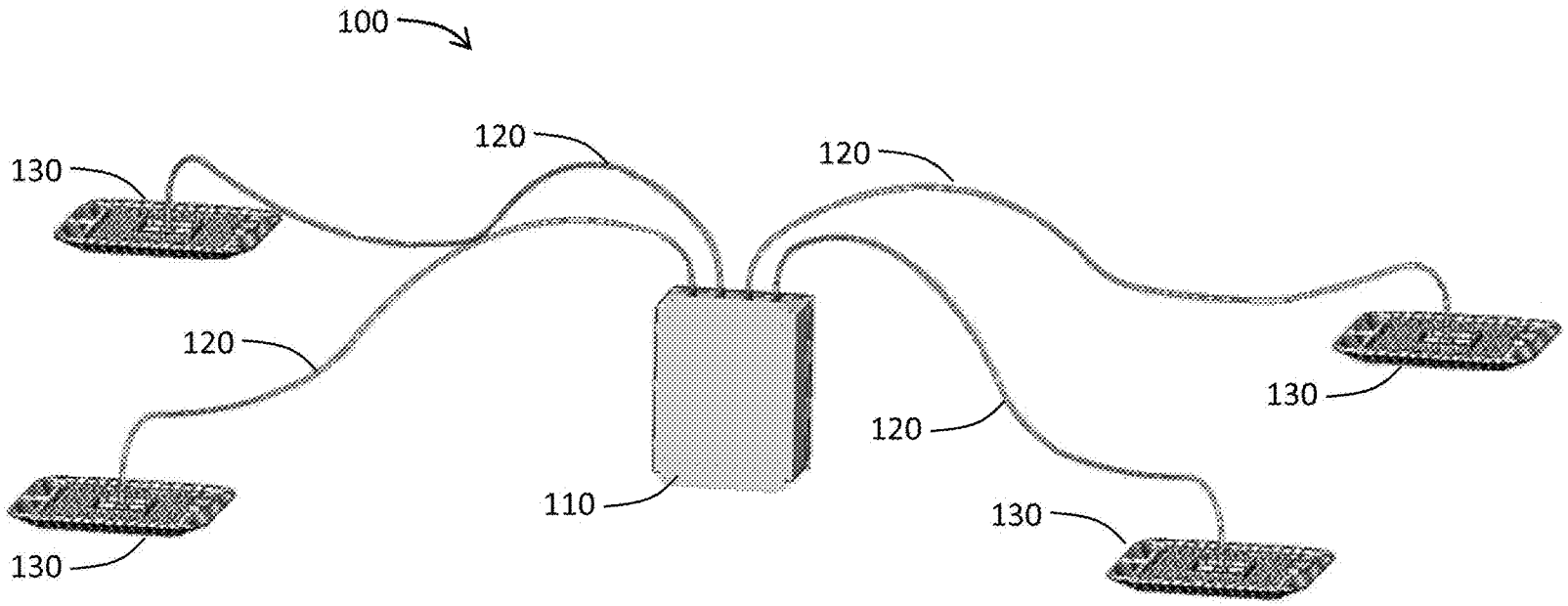
FIG. 1B is a top perspective view of the canopy light system illustrated in FIG. 1A.

Referring now to FIGS. 1A and 1B, a canopy light system 100, according to an embodiment of the present invention, will now be discussed. The canopy light system 100 may include a power supply assembly 110, at least one distribution wire 120, and at least one luminaire assembly 130. Each luminaire assembly 130 may be spaced apart from and in electrical communication with the power supply assembly 110. Each luminaire assembly 130 may be configured to receive an electric current from a respective distribution wire 120 configured to extend from one of multiple outlets on the power supply assembly 110 to the luminaire assembly 130. The present invention advantageously allows for a plurality of luminaire assemblies 130 to be readily connected to the power supply assembly 110 and also advantageously minimizes voltage drop or current fluctuations. The components comprising the canopy light system 100 may be connected by any means known in the art, including, not by limitation, use of connectors, couplings, straps, and/or clamps.

The canopy light system 100 may be used advantageously as a down light solution suitable for indoor and/or outdoor applications. In addition, the canopy light system 100 may be customizable to advantageously adapt to a number of field configurations. Although the configuration of the canopy light system 100 illustrated in FIGS. 1A and 1B shows four (4) luminaire assemblies 130 each in electrical communication with a single power supply assembly 110 through a respective distribution wire 120, the skilled artisan will appreciate that any number of luminaire assemblies 130 may be connected to a multi-output power supply assembly 110 up to the supply limit of the assembly 110. Alternatively, or in addition, multiple power supply assemblies 110 may be deployed, along with associated distribution wires 120 and luminaire assemblies 130, to provide a single down light solution for a given canopy retrofit installation. This tailoring feature advantageously may enhance the flexibility of use of the canopy light system 100.

Luminaire Assembly Configuration

Figure 2A:
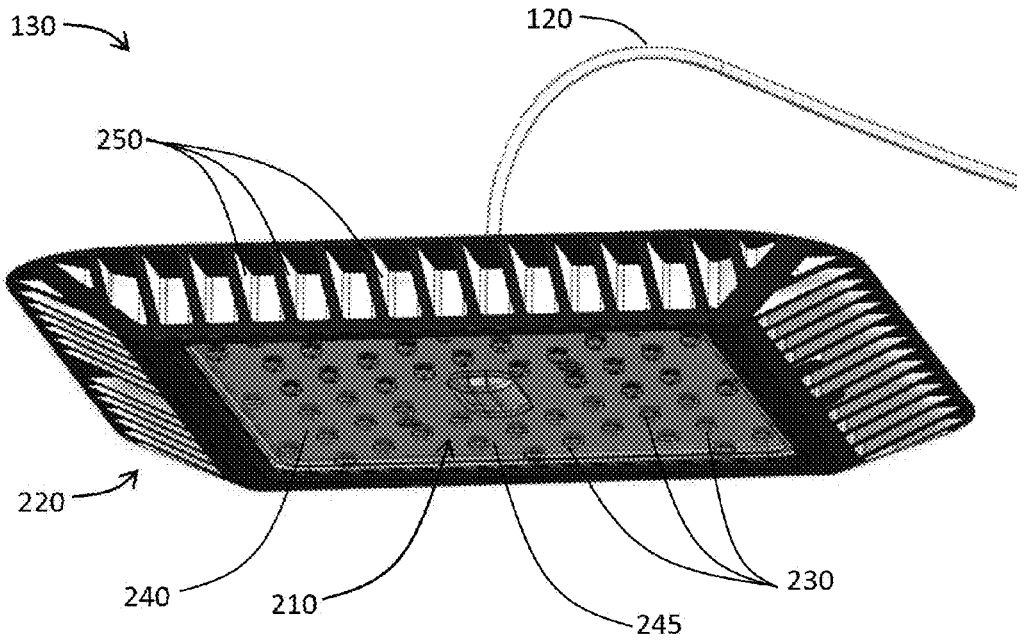
FIG. 2A is a bottom perspective view of a luminaire assembly to be used in connection with a canopy light system according to an embodiment of the present invention.
Figure 2B:
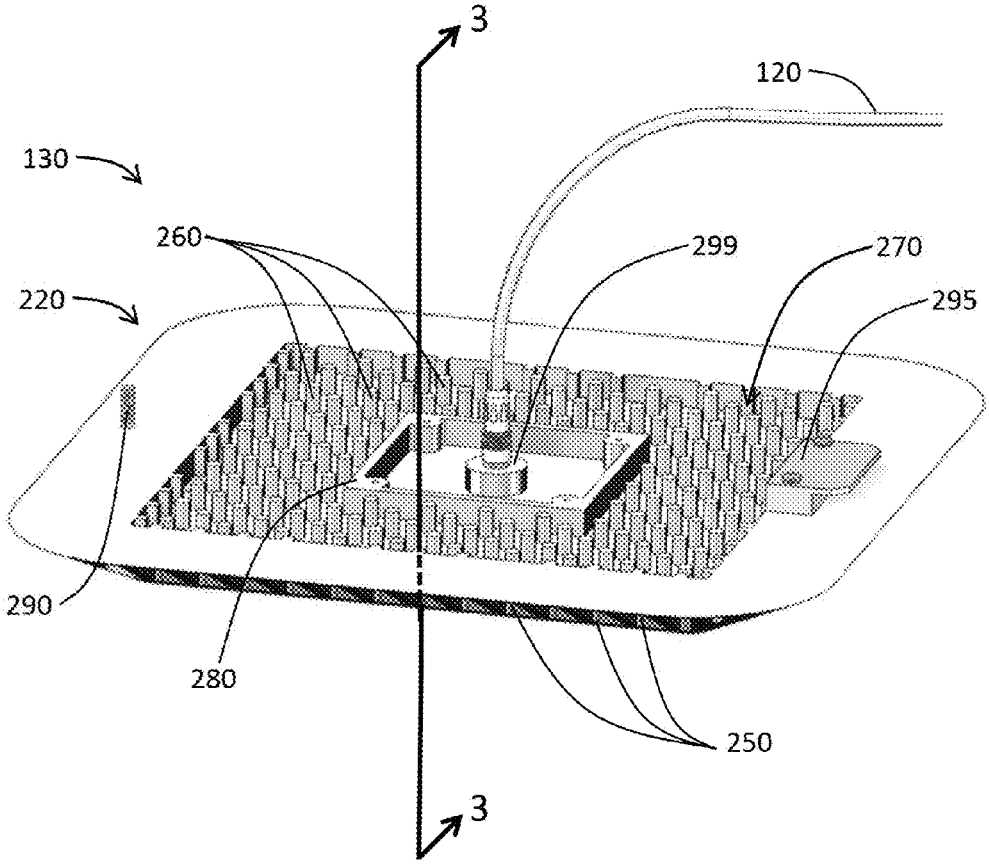
FIG. 2B is a top perspective view of the luminaire assembly illustrated in FIG. 2A.

Referring now to FIGS. 2A and 2B, and continuing to refer to FIGS. 1A and 1B, the luminaire assembly 130 of the canopy light system 100 according to an embodiment of the present invention is now discussed in greater detail. Each of a plurality of luminaire assemblies 130 may operate as a self-contained light-producing unit suitable for use with any of the lighting applications described herein. In various implementations, the luminaire assembly 130 may be used alone or together with other similar lighting assemblies in a system of lighting assemblies (e.g., as discussed above in connection with FIGS. 1A and 1B). Used alone or in combination with other lighting assemblies, the luminaire assembly 130 may be employed in a variety of applications including, but not limited to, direct-view or indirect-view interior or exterior space (e.g., architectural) lighting and illumination in general. The luminaire assembly 130 may be used in connection not only with canopy lighting systems specifically, but also generally in direct or indirect illumination of objects or spaces, theatrical or other entertainment-based/special effects lighting, decorative lighting, safety-oriented lighting, vehicular lighting, lighting associated with, or illumination of, displays and/or merchandise (e.g. for advertising and/or in retail/consumer environments), combined lighting or illumination and communication systems, as well as for various indication, display and information purposes.

Still referring to FIGS. 2A and 2B, the luminaire assembly 130 may be designed to present a low profile when installed. This design is advantageous in that it provides a cleaner look upon installation. Further, the luminaire assembly 130 according to an embodiment of the present invention may be advantageously simple and inexpensive to install and maintain. The use of LEDs 230 in connection with the low profile luminaire assembly 130 according to an embodiment of the present invention also may advantageously provide decreased operating costs with respect to energy consumption.

FIGS. 2A and 2B illustrate one example of a luminaire assembly 130 that may comprise a light source 210 and a low profile heat-dissipating frame 220. More specifically, the luminaire assembly 130 may comprise one or more light sources 210, wherein one or more of the light sources 210 may be an LED-based light source that includes one or more LEDs 230. A skilled artisan will appreciate that the luminaire assembly 130 may include any number of various types of light sources (e.g., all LED-based light sources, LED-based and non-LED-based light sources in combination) adapted to generate radiation of a variety of different colors, including essentially white light, as discussed further below. Embodiments of the present invention contemplate that any number of light sources 210 may be provided, in addition to any number of different light sources 210. Non-LED light sources may include, without limitation, lasers, incandescents, halogens, arc-lighting devices, fluorescents, and any other light-emitting devices known in the art.

Each light source 210 of the luminaire assembly 130 may comprise at least one light-emitting diode (LED) 230 that may be in mechanical and electrical communication with the lower surface of a substantially planar printed circuit board 240. Those skilled in the art will appreciate that a substantially planar printed circuit board is intended to note that the printed circuit board may have a shape that is planar. Those skilled in the art will also appreciate that shapes of the printed circuit board that are not precisely planar are meant to be included within the scope and spirit of the embodiments of the present invention. The LEDs 230 may be arranged so that each LED 230 points downward towards a target area, resulting in an advantageously inexpensive way to distribute a light pattern that covers the entire target space below the luminaire assembly 130.

Figure 3:
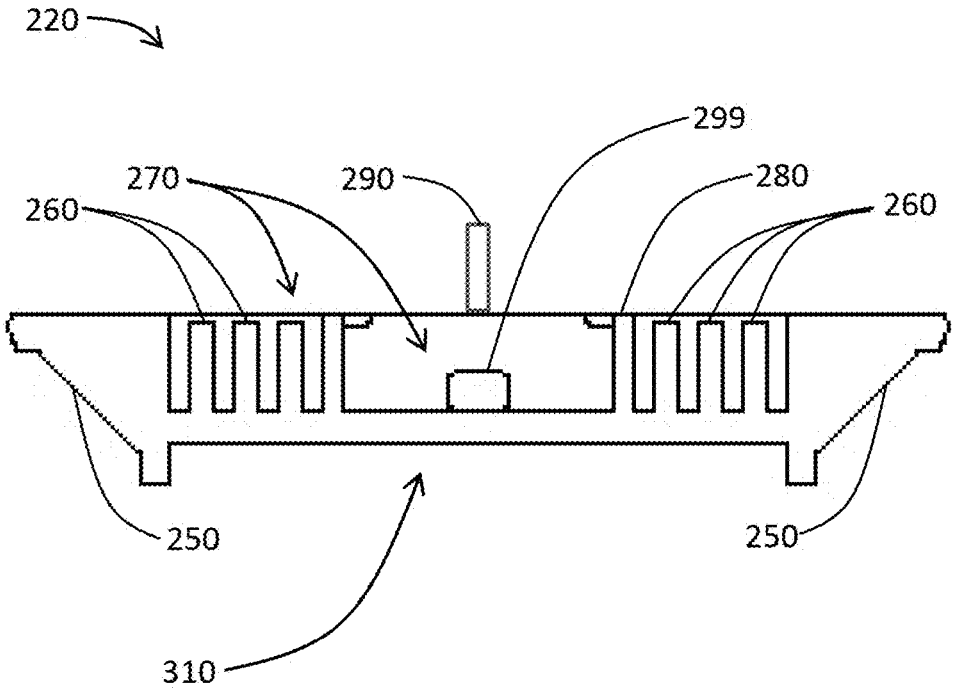
FIG. 3 is an unassembled, cross-sectional view of a heat-dissipating frame of the luminaire assembly illustrated in FIG. 2B and taken through line 3-3 of FIG. 2B.

Continuing to refer to FIGS. 2A and 2B, and referring additionally to FIG. 3, the low profile luminaire assembly 130 may comprise a substantially rectangular-shaped frame 220 that may dissipate thermal energy generated by the light source 210 to advantageously improve the performance and increase the lifespan of the luminaire assembly 130. Those skilled in the art will appreciate that a substantially rectangular shape is intended to note that the frame may have a shape that is polygonal. Those skilled in the art will also appreciate that shapes of the frame that are not precisely rectangular nor polygonal are meant to be included within the scope and spirit of the embodiments of the present invention.

For example, and without limitation, the heat-dissipating frame 220 may have a bottom portion comprising a central indentation 310. The light source 210 may be carried within the central indentation 310 in the frame 220, and may be in thermal contact with the frame 220 such that heat generated by one or more light sources 210 within the luminaire assembly 130 may therefore be conducted, or passed, to the heat-dissipating frame 220. The frame 220 may be characterized by a heat dissipation rate that equals or exceeds a combined heat generation rate of the one or more light sources 210.

For example, and without limitation, the frame 220 may be constructed of a thermally conductive material, such as thermoplastic, ceramics, porcelain, aluminum, aluminum alloys, metals, metal alloys, carbon allotropes, thermally conductive polymers, and composite materials. Additional information directed to the use of heat sinks for dissipating heat in an illumination apparatus is found in U.S. Pat. No. 7,922,356 titled Illumination Apparatus for Conducting and Dissipating Heat from a Light Source, and U.S. Pat. No. 7,824,075 titled Method and Apparatus for Cooling a Light Bulb, the entire contents of each of which are incorporated herein by reference. In various implementations, the heat-dissipating frame 220 may be formed as a monolithic unit by molding, casting, or stamping.

For example, and without limitation, a mounting bore 245 may be disposed at a geometric center of the light source 210 to affix the printed circuit board 240 in a position adjacent the central indentation 310. Alternatively, or in addition, thermal coupling of the light source 210 with the frame 220 may be accomplished by any method, including thermal adhesives, thermal pastes, thermal greases, thermal pads, and all other methods known in the art. Where a thermal adhesive, paste, or grease is used, the central indentation 310 may be connected to any part of the printed circuit board 240 as may effectively cause thermal transfer from the LEDs 230 to the heat-dissipating frame 220. Connection point location largely may depend on the heat distribution within the light source 210. For example, the central indentation 310 may be thermally coupled to one or more LEDs 230, to the circuit board 240, or to both so as to increase the thermal dissipation capacity of the luminaire assembly 100. The method of thermal coupling may be selected based on criteria including ease of application/installation, thermal conductivity, chemical stability, structural stability, and constraints placed by the luminaire assembly 100.

Continuing to refer to FIG. 2A, the bottom portion of the frame may include a plurality of heat sink fins 250 which, as understood in the field of heat sinks, may be used to dissipate heat generated by operation of the light source 210. The fins 250 may provide a larger surface area that may otherwise be provided by the surface of the frame 220 through which heat may be readily dissipated. Employment of multiple heat sink fins 250 may increase the surface area of the frame 220 and may permit thermal fluid flow between adjacent fins 250, thereby enhancing the cooling capability of the frame 220. Additionally, multiple heat sink fins 250 may be identical in shape. Those skilled in the art will readily appreciate, however, that the fins 250 of the heat-dissipating frame 220 may be configured in any way while still accomplishing the many goals, features and advantages according to the present invention.

In the embodiment of the invention illustrated in FIGS. 2A and 3, the series of triangular heat sink fins 250 may be disposed along the length of each side of the frame 220, and configured such that the plane defined by each fin 250 may project perpendicularly downward from the plane defined by the top of the frame 220. The heat sink fins 250 may be positioned between an outer edge of the central indentation 310 and a perimeter of the top edge of the frame 220. The heat sink fins 250 may be distributed substantially equidistant from each other along the perimeter of the frame 220. Those skilled in the art will appreciate that use of the term "substantially" when describing the distance between any two heat sink fin 250 pairs is meant to be inclusive of any distance that advantageously forms a heat-dissipating channel between a pair of heat sink fins 250. It is to be understood that heat sink fin 250 pairs are contemplated to be spaced at any distance suitable for dissipating heat, regardless of whether a uniform distance is maintained across all heat sink fin 250 pairs. Those skilled in the art will appreciate, however, that the present invention contemplates the use of heat sink fins 250 that extend any distance, and that the disclosed frame 220 that includes fins 250 disposed along the length of each side thereof is not meant to be limiting in any way. The configuration of the heat sink fins 250 may be as described above, or according to the direction of the incorporated references.

Continuing to refer to FIGS. 2B and 3, the heat-dissipating frame 220 may have a top portion configured for flush mounting with a surface such as, for example, a canopy ceiling. The top portion of the frame 220 may include a plurality of heat sink bars 260. For example, and without limitation, the heat sink bars 260 may be distributed substantially equidistant from each other and positioned within at least one recess 270 located on the frame 220 substantially opposite the central indentation 310. Those skilled in the art will appreciate that use of the term "substantially" when describing the relative positions of the recess 270 and the central indentation 310 is meant to be inclusive of any positioning that advantageously forms a heat-dissipating region adjacent the central indentation 310 when in thermal communication with the light source 210. It is to be understood that recess 270 and central indentation 310 are contemplated to be configured in any complementary positions suitable for dissipating heat. Each heat sink bar 260 may protrude upward from the bottom of the recess 270 in which the bar 260 is housed, and may terminate flush with the plane defined by the top of the heat-dissipating frame 220. The configuration of the heat sink bars 260 may be as described above, or according to the direction of the incorporated references.

At least one low-voltage DC electrical connector 299 may pass through at least one aperture (not shown) in the top portion of the frame 220 to form a passageway through which electric current may be delivered to the light source 210. In various implementations of the present invention, the luminaire assembly 130 also may be configured as a retrofit to mechanically engage a conventional fixture arrangement. For example, and without limitation, the top portion of the frame 220 may comprise a mechanism for engaging the top portion of the frame 220 with a canopy fixture adjacent to a surface, such as a ceiling or a wall. The engagement mechanism may comprise an integral mounting bracket 280 configured for attachment of the luminaire assembly 130 to a conventional junction box, such as those typically used for legacy downlight systems. Alternatively, or in addition, the engagement mechanism may comprise a combination bolt 290 and support anchor 295.

Each luminaire assembly 130 also may comprise one or more optics (not shown) that may be mounted to the bottom portion of the frame 220 and positioned to form an optical chamber that may enclose the light-emitting elements of the light source 210. For example, in the present embodiment, the optic may be configured to interact with light emitted by the LEDs 230 to refract incident light. Accordingly, the LEDs 230 may be disposed such that light emitted therefrom is incident upon the optic. The optic may be formed in any shape to impart a desired refraction. For example, and without limitation, the optic may have a generally concave geometry. Additionally, the optic may be configured to generally diffuse light incident thereupon, and from a material that refracts or collimates light emitted by the LEDs 230. Furthermore, the optic may be formed of any material with transparent or translucent properties that comport with the desired refraction to be performed by the optic. For example, the optic may include an extruded refractory material. Alternatively, or in addition, an exemplary material for the optic may be an acrylic material, such as cast acrylic or extruded acrylic. In addition, the optic may be formed of cast acrylic with diamond polishing. Acrylic materials may be suitable for the optic due to their excellent light transmission and UV light stability properties.

It is contemplated that a coating may be placed on an optic to convert a wavelength of light emitted by the light source 210 so that the wavelength is defined has having a converted wavelength range. For additional disclosure regarding coatings used to convert a wavelength of a source light, see U.S. Pat. No. 8,408,725 title Remote Light Wavelength Conversion Device and Associated Methods, U.S. patent application Ser. No. 13/234,371 titled Color Conversion Occlusion and Associated Methods, and U.S. patent application Ser. No. 13/357,283 titled Dual Characteristic Color Conversion Enclosure and Associated Methods, the entire contents of each of which are incorporated herein by reference.

Power Supply and Distribution

Figure 4:
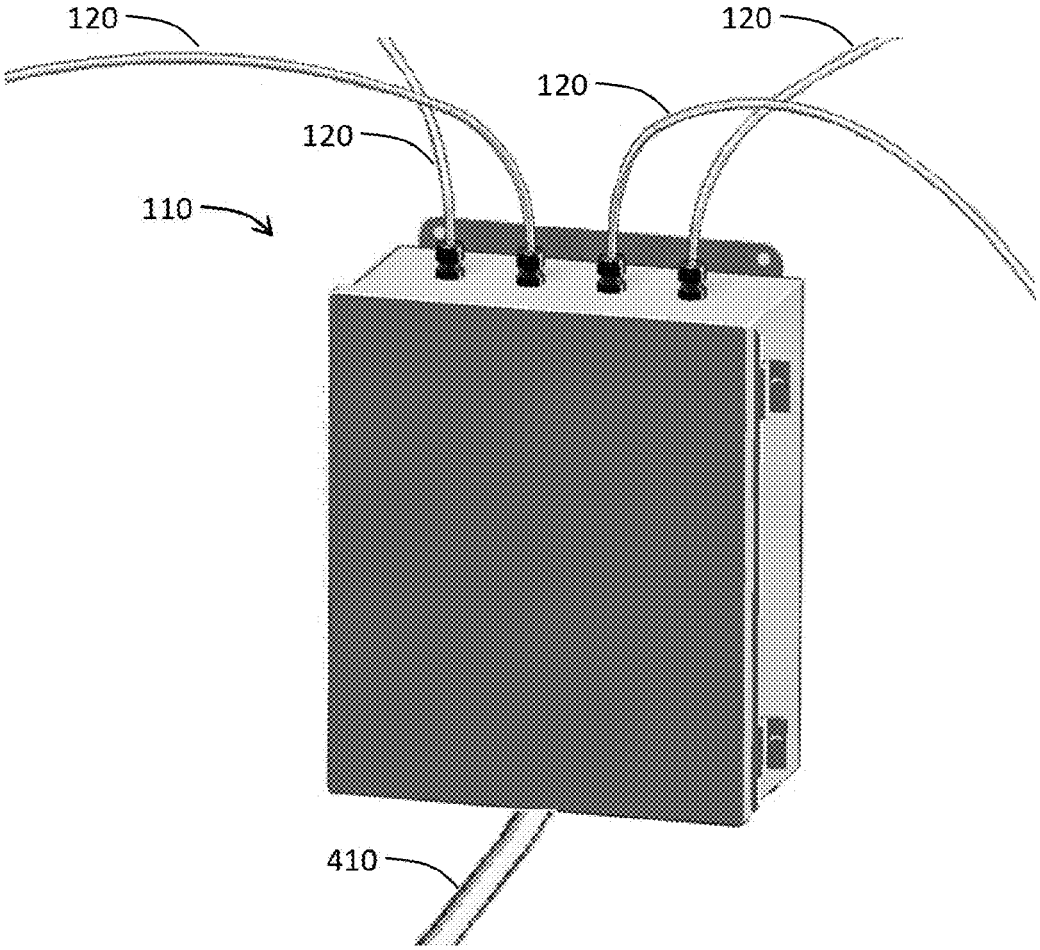
FIG. 4 is a perspective view of a power supply assembly of a canopy light system according to an embodiment of the present invention.

Referring again to FIGS. 1A and 1B, and referring additionally to FIG. 4, a power supply assembly 110 and plurality of distribution wires 120 used to deliver DC power to the plurality of luminaire assemblies 130 according to an embodiment of the present invention are discussed in greater detail. For example, and without limitation, a power supply assembly 110 may be mechanically mounted on a wall or ceiling at a distance from the legacy luminaires to be replaced. A person skilled in the art will appreciate that any manner of mounting the power supply assembly 110 to a surface may be used. The power supply assembly 110 may be configured to be in electrical communication with each of the plurality of luminaire assemblies 130 through use of a respective distribution wire 120. An electrical connector 299 may support mechanical attachment of each low-voltage distribution wire 120 to the respective luminaire assembly 130.

For example, and without limitation, the power supply assembly 110 may be in the form of a remote power supply unit configured to deliver electrical power to LEDs 230 present in one or more of the luminaire assemblies 130. The remote power supply assembly 110 may have a converter (not shown) that may convert an AC input voltage to a DC output voltage. The on-board power supply unit 110 also may have a regulator (not shown) that may sustain a DC output voltage within a target DC bias range. For example, and without limitation, the DC output voltage may be 12 volts or less.

In one embodiment, the remote power supply assembly 110 may have at least one wire connector (not shown) configured to receive the AC input voltage through conductive coupling to an external power source 410 (as illustrated in FIG. 4). Alternatively, the power supply assembly 110 may have at least one power terminal (not shown) that receives power from the external power source 410. Additional information directed to the use of power sources to deliver electric current to an illumination apparatus suitable for use with the canopy lighting system 100 according to an embodiment of the present invention may be found, for example, in U.S. Provisional Patent Application No. 61/486,322 titled Variable Load Power Supply, the entire contents of which are incorporated herein by reference.

As shown in the embodiment of FIGS. 1A, 1B, and 4, a plurality of low-voltage distribution wires 120 may distribute converted and regulated power from a multi-output power supply assembly 110 to each luminaire assembly 130. The power supply assembly 110 of the present invention may intelligently distribute power to drive LEDs 230 using low-voltage distribution wires 120 of an appropriate length, thereby advantageously operating the light sources 210 with increased efficiency and decreased flicker. More specifically, because the external power source 410 may deliver power as an alternating current, the instantaneous voltage delivered by the power source 410 may continually increase and decrease. For increased efficiency, the power supply assembly 110 of the present invention may drive longer low-voltage distribution wires 120 as the instantaneous voltage supplied by the power source 410 may be higher.

This power distribution design may advantageously eliminate the need for power adapter devices deployed on-board each luminaire assembly 130. The power distribution design also may replace the high-voltage distribution wire used to deliver AC power to legacy luminaires in a canopy with a lighter, low-voltage distribution wire 120. Smaller, low-voltage distribution wire 120 may not only advantageously simplify the task of retrofit installation, but also may advantageously reduce risk associated with electrocution. For example, and without limitation, each distribution wire may comprise a wire of a gauge not wider than 20 AWG and a length of at least 10 feet. In some embodiments of the canopy lighting system 100 according to the present invention, the low-voltage distribution wires 120 may be weather-resistant.

Retrofit Installation

Figure 5:
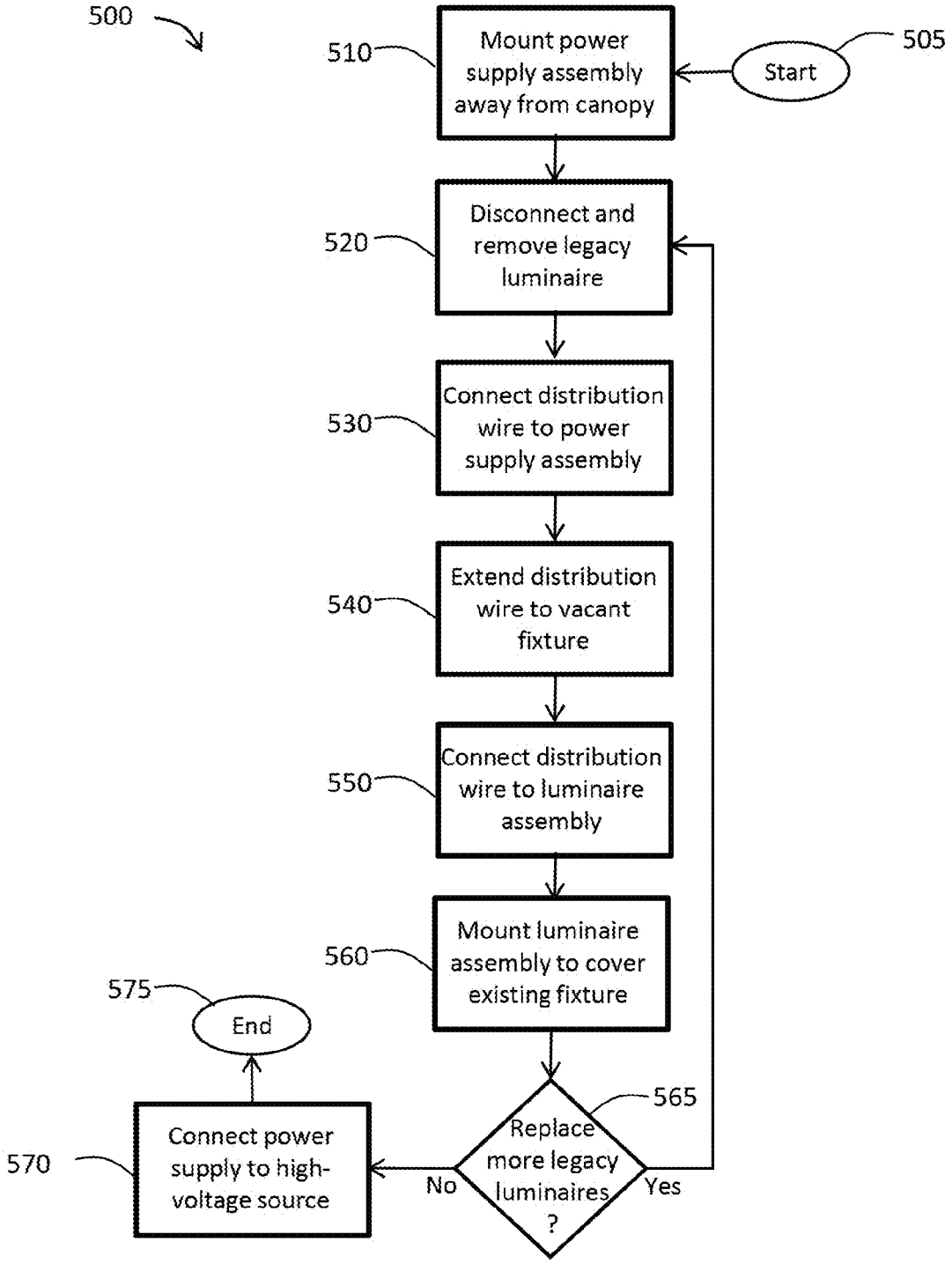
FIG. 5 is a flow chart illustrating a method of installing a canopy light system according to an embodiment of the present invention.

Referring now to flow chart 500 of FIG. 5, and continuing to refer to FIGS. 1A and 1B, a method aspect for installing a retrofit canopy light system 100 according to one embodiment of the present invention is discussed in detail. From the start 505, the method may include the step of mounting the power supply assembly 110 (Block 510). For example, and without limitation, mounting may include attaching the power supply assembly 110 to a wall, cabinet, or other preexisting mounting space. The distance at which the power supply assembly 110 is mounted apart from each of the canopy fixtures to be retrofitted may be significant because of the impact the phenomenon of voltage drop at 12 volts DC may have on system 100 performance. For example, a 1 volt drop from 12 volts causes 10 times the power loss of a 1 volt drop from 120 volts. In general, shorter distances between the power supply assembly 110 and the canopy fixtures to be retrofitted may facilitate the use of smaller distribution wire 120 during subsequent method steps for ease of installation and material cost benefit purposes. For example, and without limitation, the power supply assembly 110 may be mounted at a distance of at least 10 feet from the fixture to be retrofitted and may be configured to transmit 12V DC to a wire of a gauge not wider than 20 AWG.

At Block 520, a legacy luminaire in the canopy structure may be disconnected from its electrical power source and removed from its housing (likely a fixture) in the canopy. For example, and without limitation, the vacated space may present an opening that is coplanar with the ceiling of the canopy (no downward protrusions). Any existing high voltage wiring that may have been used to carry AC power to the legacy luminaire may be disconnected and either removed or left dormant (no power).

At Block 530, a first end of a distribution wire 120 may be connected to one of multiple outputs that may be available on the power supply assembly 110. This connection may be accomplished by any means known in the art, including, not by limitation, use of connectors, couplings, straps, and/or clamps. At Block 540, the unattached second end of the distribution wire 120 may be extended to the fixture that was vacated by the removal of the legacy luminaire. The path for extending the distribution wire 120 may be tailored to the constraints of the particular installation including, but limited to safety, environmental, mechanical, and electrical carrying capacity constraints. The second end of the distribution wire 120 may be electrically connected to a luminaire assembly 130 at Block 550 before the luminaire assembly 130 may be mounted to the ceiling of the canopy (Block 560). For example, and without limitation, the luminaire assembly 130 may be positioned to cover the opening in the canopy vacated by the legacy luminaire.

If at Block 565, it is determined that additional legacy luminaires are to be replaced in the canopy, then the next legacy luminaire may be disconnected and removed at Block 520 in preparation for a retrofit as described above (Blocks 530 through 560). After no more legacy luminaires remain to be replaced (Block 565), then at Block 570 the power supply assembly 110 may be electrically connected to a high-voltage power source 410 (as illustrated in FIG. 4) before the method ends at Block 575.

Some of the illustrative aspects of the present invention may be advantageous in solving the problems herein described and other problems not discussed which are discoverable by a skilled artisan. While the above description contains much specificity, these should not be construed as limitations on the scope of any embodiment, but as exemplifications of the presented embodiments thereof. Many other ramifications and variations are possible within the teachings of the various embodiments. While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. For example, and without limitation, after Block 560, a determination may be made whether or not to add an optic (not shown) external to the luminaire assembly 130 before continuing with the retrofit method as described above. Therefore, it is intended that the invention not be limited to the particular embodiment disclosed as the best or only mode contemplated for carrying out this invention, but that the invention will include all embodiments falling within the scope of the appended claims.

Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

Many modifications and other embodiments of the invention will come to the mind of one skilled in the art having the benefit of the teachings presented in the foregoing descriptions and the associated drawings. The scope of the invention should be determined by the appended claims and their legal equivalents, and not by the examples given. Therefore, it is understood that the invention is not to be limited to the specific embodiments disclosed.

What is claimed is:

1. A retrofit lighting system, comprising:

a power supply assembly configured to convert an AC input voltage into a DC output voltage and to adapt the DC output voltage to a substantially constant current level to be defined as a regulated current;

at least one distribution wire in electrical communication with the power supply assembly and configured to conduct the regulated current; and at least one respective luminaire assembly spaced apart from and in electrical communication with the power supply assembly, and configured to receive the regulated current from the at least one distribution wire, the luminaire assembly comprising:

a low profile heat-dissipating frame comprising a top portion and a bottom portion and being constructed of one or more thermally conductive materials selected from the group consisting of metals, metal alloys, ceramics, and thermally conductive polymers; and a light source in thermal contact with the frame;

wherein the DC output voltage is about 12 volts or less.

2. A retrofit lighting system according to claim 1 wherein the at least one respective luminaire assembly is a plurality of respective luminaire assemblies and the at least one distribution wire is a plurality of distribution wires so that one distribution wire is configured to extend to one luminaire assembly.

3. A retrofit lighting system according to claim 1 wherein the at least one distribution wire comprises a wire of a gauge not wider than 20 AWG and a length of at least 10 feet.

4. A retrofit lighting system according to claim 1 wherein the at least one distribution wire further comprises a protective cover constructed of a weather-resistant material.

5. A retrofit lighting system according to claim 1 wherein the light source comprises at least one light emitting diode (LED).

6. A retrofit lighting system according to claim 1 wherein the top portion of the frame is configured for flush mounting with a surface.

7. A retrofit lighting system according to claim 1 wherein the bottom portion of the frame has a central indentation; and wherein the light source is carried within the central indentation in the frame.

8. A retrofit lighting system according to claim 7 wherein the bottom portion of the frame includes a plurality of heat sink fins positioned between an edge of the central indentation and a perimeter of the frame, the plurality of heat sink fins distributed substantially equidistant from each other along the perimeter of the frame.

9. A retrofit lighting system according to claim 7 wherein the top portion of the frame includes a plurality of heat sink bars distributed substantially equidistant from each other and positioned within at least one recess substantially opposite the central indentation.

10. A retrofit lighting system, comprising:

a power supply assembly configured to convert an AC input voltage into a DC output voltage and to adapt the DC output voltage to a substantially constant current level to be defined as a regulated current;

at least one distribution wire in electrical communication with the power supply assembly and configured to conduct the regulated current; and at least one respective luminaire assembly spaced apart from and in electrical communication with the power supply assembly, and configured to receive the regulated current from the at least one distribution wire, the luminaire assembly comprising:

a low profile heat-dissipating frame comprising a top portion and a bottom portion, the bottom portion including a central indentation and a plurality of heat sink fins positioned between an edge of the central indentation and a perimeter of the frame, the plurality of heat sink fins distributed substantially equidistant from each other along the perimeter of the frame; and a light source in thermal contact with the frame;

wherein the DC output voltage is about 12 volts or less.

11. A retrofit lighting system, comprising:

a power supply assembly configured to convert an AC input voltage into a DC output voltage and to adapt the DC output voltage to a substantially constant current level to be defined as a regulated current;

at least one distribution wire in electrical communication with the power supply assembly and configured to conduct the regulated current; and at least one respective luminaire assembly spaced apart from and in electrical communication with the power supply assembly, and configured to receive the regulated current from the at least one distribution wire, the luminaire assembly comprising:

a low profile heat-dissipating frame comprising a top portion and a bottom portion, the bottom portion comprising a central indentation and the top portion comprising a plurality of heat sink bars distributed substantially equidistant from each other and positioned within at least one recess substantially opposite the central indentation; and a light source in thermal contact with the frame;

wherein the DC output voltage is about 12 volts or less;

wherein the bottom portion of the frame has a central indentation; and wherein the top portion of the frame includes a plurality of heat sink bars distributed substantially equidistant from each other and positioned within at least one recess substantially opposite the central indentation.

* * * * *